US005156644A

United States Patent [19]

Koehler et al.

[11] Patent Number: 5,156,644

[45] Date of Patent: Oct. 20, 1992

[54] SAFETY RELEASE BINDING

[76] Inventors: Gary W. Koehler, 1900 Ascot Dr., Moraga, Calif. 94556; Erik Strand, 17 Wendy La., Orinda, Calif. 94563

[21] Appl. No.: 779,635

[22] Filed: Oct. 21, 1991

[51] Int. Cl.[5] ..... A63C 9/08; A63C 7/00

[52] U.S. Cl. ..... 280/14.2; 280/605; 280/607; 24/68 SK; 24/442; 24/585

[58] Field of Search ..... 280/11.16, 11.2, 11.27, 280/11.28, 14.2, 604, 605, 607, 611, 633, 636, 87.042, 811; 114/39.2; 441/70; 24/68 SK, 306, 442, 585

[56] References Cited

U.S. PATENT DOCUMENTS

| | | | |
|---|---|---|---|
| 3,526,867 | 9/1970 | Keeler, II | 24/442 X |
| 3,884,487 | 5/1975 | Wehrli | 280/605 |
| 4,012,057 | 3/1977 | Courvoisier | 280/605 |
| 4,108,452 | 8/1978 | Baron | 280/11.3 |
| 4,290,174 | 9/1981 | Kalleberg | 24/444 |
| 4,741,550 | 5/1988 | Dennis | 280/14.2 X |
| 4,846,744 | 7/1989 | Love | 280/11.3 X |
| 5,021,017 | 6/1991 | Ott | 280/14.2 X |
| 5,035,443 | 7/1991 | Kincheloe | 280/14.2 X |
| 5,040,275 | 8/1991 | Eckhardt et al. | 24/442 X |

FOREIGN PATENT DOCUMENTS

| | | | |
|---|---|---|---|
| 3603258 | 10/1987 | Fed. Rep. of Germany | 441/70 |
| 3702093 | 8/1988 | Fed. Rep. of Germany | 280/607 |
| 3712807 | 11/1988 | Fed. Rep. of Germany | 280/607 |

*Primary Examiner*—Andres Kashnikow
*Assistant Examiner*—Brian L. Johnson
*Attorney, Agent, or Firm*—Robert J. Henry

[57] ABSTRACT

In accordance with the invention, a kinematically correct safety release binding is provided. Specifically, the invention provides a safety release binding for attachment of a foot of a user to a riding device; comprising a first attachment unit formed to be secured to the foot of the user, with said first attachment unit comprising a substantially plane surface throughout a central portion thereof, a support surface at each end thereof, and a first set of cohesive interlocking elements secured to the plane surface at the central portion thereof; a second attachment unit secured to the riding device and formed with substantially plane surface having a second set of cohesive interlocking elements secured thereon; and a pair of support pads disposed between the riding device and the support surfaces of the first attachment unit when the units are in operative position; said support pads being formed to provide the spacing between the first and second set of interlocking elements, whereby controlling forces are transferred between the foot of the user and the riding device and an excessive force causes disengagement of the interlocking elements of the attachment units and release of the user's foot from the riding device. In addition, a novel brake mechanism is provided in a preferred form of the invention.

12 Claims, 3 Drawing Sheets

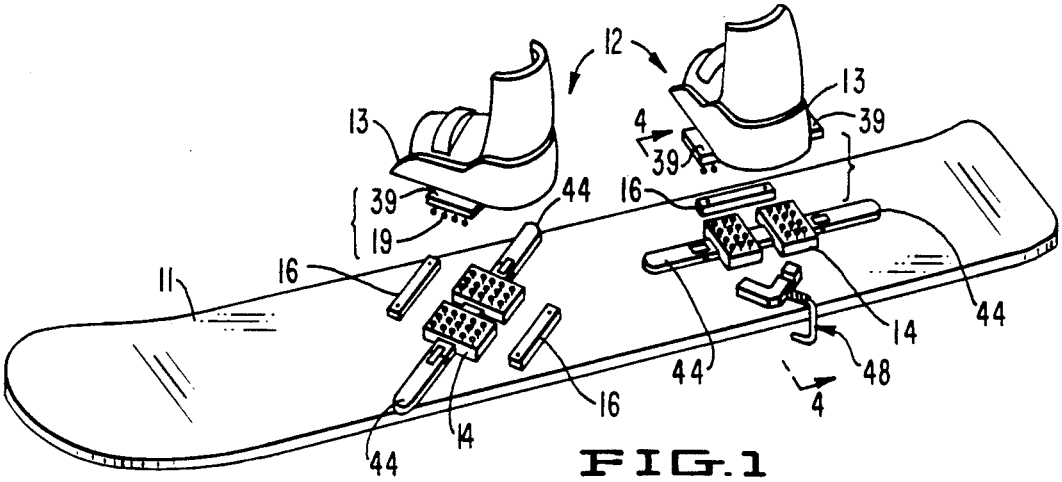
FIG.1
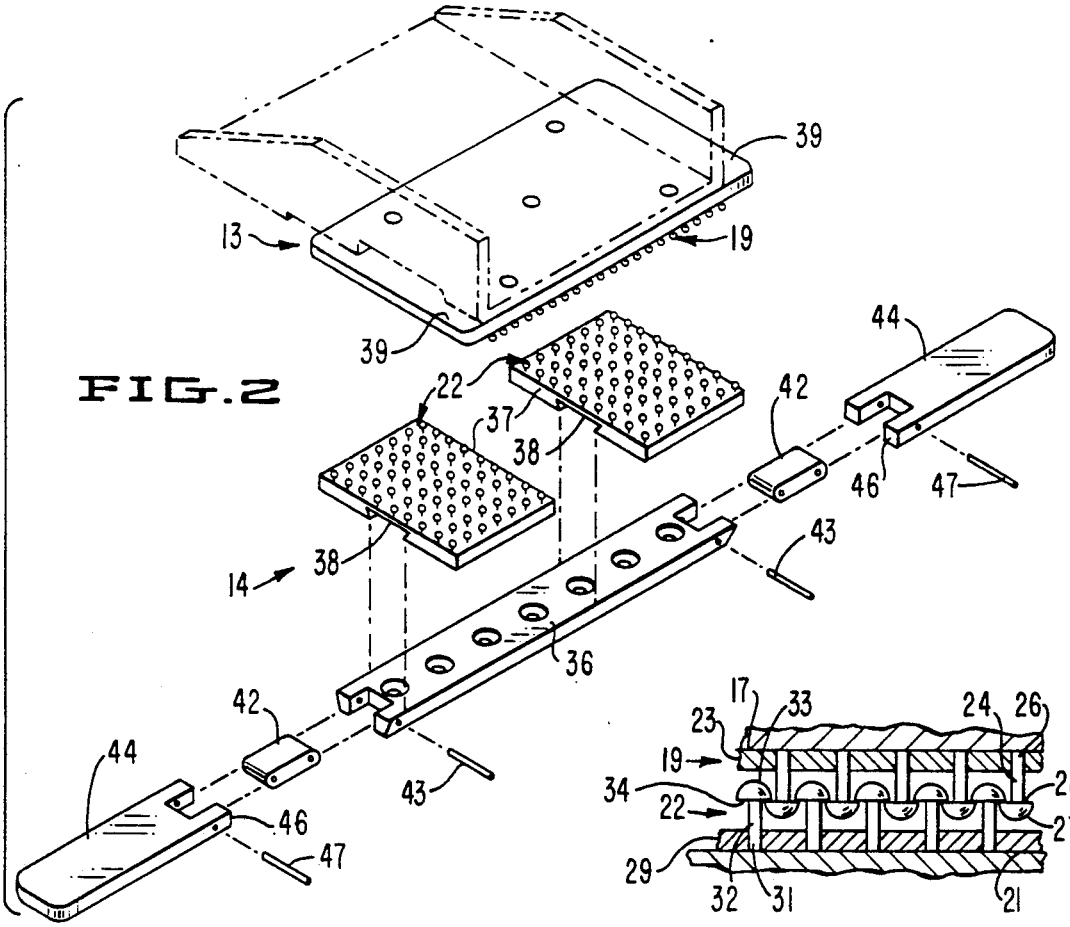
FIG.2
FIG.3

SAFETY RELEASE BINDING

BACKGROUND OF THE INVENTION

1. Field of the Invention

The present invention relates to a safety release binding for a riding device and more particularly to a safety release binding for a monoski or snowboard (wherein both feet are supported on the same board). In addition, a novel brake for use on snowboards and other snow ski devices is described.

2. Description of Background and Relevant Information

Safety release bindings are well known in the ski art, and their usefulness in preventing certain injuries is unquestioned. In addition, safety release bindings have been used on other types of riding devices. For example, U.S. Pat. No. 4,108,452 shows a releasable fastener for a skateboard, and U.S. Pat. 4,846,744 shows a releasable fastener for a sailboard. For these reasons, release bindings having the correct properties are of generic application even though they are most used in the ski art.

In all of these applications, it is important for the user to have control of the riding device, i.e. the ability to apply tilting and rotational forces to the device. This requirement is particularly important in the case of a snowboard or monoski, however, it is valuable in the operation of all riding devices.

Release bindings in use at the time of this invention are generally used in conventional skiing where two skis are used. In these applications, each ski boot is individually attached to each ski, generally at the heel and toe of the ski boot. Such attachment has the disadvantage of not allowing uniform release in all directions. Prior to this invention, monoskis or snowboards (wherein both feet are supported on the same board) are becoming popular, but the release bindings used in conventional skis have not been considered sufficiently satisfactory to appear in any of the initially marketed snowboards.

In addition to the control needs described above, it follows that the safest release binding would be one that could release in any direction without restricting the ski boot movement so as to minimize the chance of injury to the skier. To do so, a release binding must comply with certain principles of kinematics, that being the following: A rigid body has six degrees of freedom, three being translational movement about three mutually perpendicular axes, and the other three being rotational movement about each of these three axes. It becomes apparent immediately that with the style of release binding that secures the ski boot at the heel and toe, some of the degrees of freedom described are lost, thereby decreasing the protection against injury to the skier. It is not the purpose here to describe what degrees of freedom are lost in conventional devices because of the great number of devices reported. However, it is to be pointed out the releasability in all of the degrees of freedom are advantageous.

SUMMARY OF THE INVENTION

In accordance with the invention, a kinematically correct safety release binding is provided. Specifically, the invention provides a safety release binding for attachment of a foot of a user to a riding device; comprising a first attachment unit formed to be secured to the foot of the user, with said first attachment unit comprising a substantially plane surface throughout a central portion thereof, a support surface at each end thereof, and a first set of cohesive interlocking elements secured to the plane surface at the central portion thereof; a second attachment unit secured to the riding device and formed with a substantially plane surface having a second set of cohesive interlocking elements secured thereon; and a pair of support pads disposed between the riding device and the support surfaces of the first attachment unit when the units are in operative position; said support pads being formed to provide the spacing between the first and second set of interlocking elements, whereby controlling forces are transferred between the foot of the user and the riding device and an excessive force causes disengagement of the interlocking elements of the attachment units and release of the user's foot from the riding device.

It is seen from the binding described that the binding has two planar surfaces secured by a cohesive interface which allows for release in the three translational movements plus the three rotations about them as described above. It is also apparent that the cohesive interlocking elements are of particular importance to the invention. Preferably, each of the first and second set of cohesive interlocking elements comprise a holding layer for holding the interlocking elements, and means for securing each holding layer to the plane surfaces of the first and second attachment units, each of said interlocking elements being composed of flexible, resilient, elastomeric material and formed with a stem portion held within the holding layer, and a semispherical head portion wider than the stem portion to provide a cam surface capable of engagement with the cam surface of opposing interlocking elements.

These cohesive interlocking elements are well known in the fastener art and examples of suitable interlocking elements are fully described in U.S. Pat. Nos. 3,270,408; 4,216,257; 4,290,174; 4,290,832; and 4,322,875. Insofar as they are pertinent, these patents are hereby incorporated herein by reference. In general, the forces required to force the interlocking elements into engagement is rather large and area dependent, and the preferred device is equipped with clamping means to effect the engagement.

Another feature of the invention is provided by adjustment of the releasing force necessary to cause release. This is achieved by providing means for locating the relative positions and degree of overlap and attached area of the interlocking elements. In this way, the release forces can be adjusted for a small child or a mature adult without changing the parts of the device.

The device is particularly suitable for use in snowboards or monoskis, because of the excellent control capability of the user. With both feet carried on the snowboard through a pair of safety release bindings, the user can transmit forces in all six types of motion for control of the snowboard, while at the same time the binding is releasable through any one of the six degrees of freedom or combinations thereof.

When the safety release binding is used on a snowboard or snow ski, it is important to provide a brake to prevent loss of the snowboard or ski after full release. Accordingly, the invention also provides a brake which acts in cooperation with the first attachment unit of the binding. The brake is mounted on the snowboard near the side thereof and under the normal operative position of the first attachment means. The brake comprises a housing secured to the snowboard and having a recess on the upper surface thereof, said housing also having an elongated internal chamber open at one end and containing female threads at the opening, a generally U-shaped rod member having a multi-start high-helix male threaded section at one end of one leg with the male threads fitting the aforesaid female threads and having the other leg of the U fitting into the recess on the upper surface of the housing when the male end is within the chamber. Spring means are also located within the chamber, and are compressed to urge the threaded portion of the U-shaped rod member outward thereby causing rotation from the position with the other leg of the U-shaped member housed in the recess to a final position below the snowboard. The brake also comprises lock means for holding the leg of the U-shaped member in the recess, and means for releasing said lock means while holding the U-shaped member in a ready position.

BRIEF DESCRIPTION OF THE DRAWINGS

The above mentioned features and advantages as well as others that will appear more clearly from the nonlimiting detailed description of the preferred embodiment which follows. This embodiment is illustrated in the accompanying drawings wherein like numerals are given to identify like parts throughout, and in which:

FIG. 1 shows a perspective of a snowboard equipped with the safety release device of the invention with the engagable parts separated to more clearly illustrate the parts;

FIG. 2 is an exploded view of most of the parts in the device;

FIG. 3 is an enlarged partial sectional view showing the interlocking elements;

DESCRIPTION OF THE PREFERRED EMBODIMENTS

Figure 4:
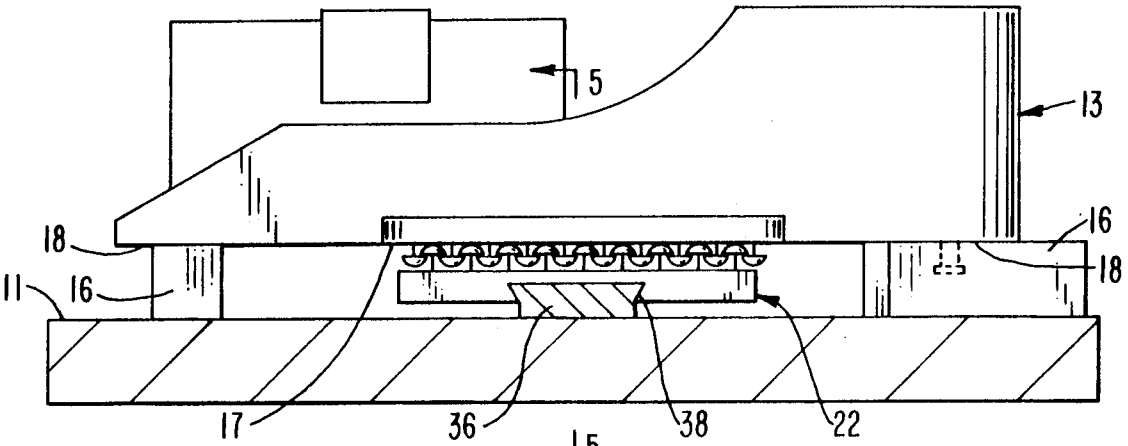
FIG. 4 is an enlarged sectional view taken substantially in the plane of line 4—4 of FIG. 1, but with the interlocking elements in engagement.
Figure 5:
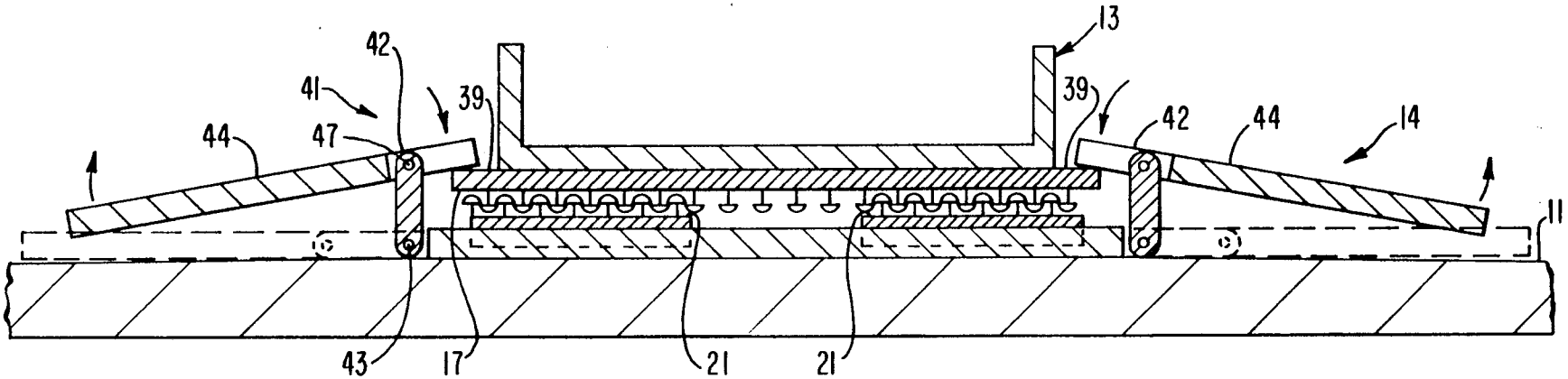
FIG. 5 is a sectional view taken substantially in the plane of line 5—5 of FIG. 4.
Figure 6:
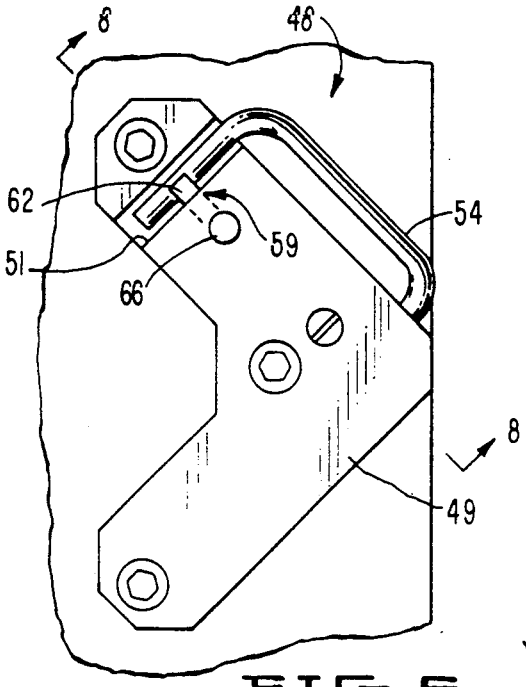
FIG. 6 is a plan view of the brake as it appears in the locked position.
Figure 7:
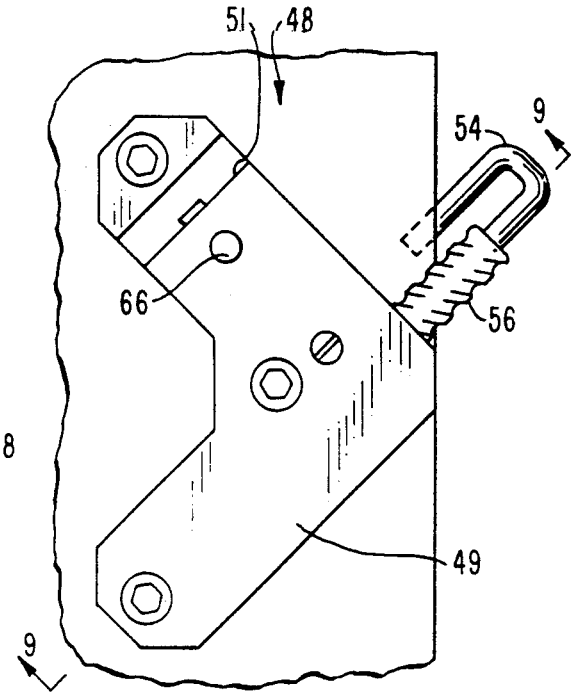
FIG. 7 is a plan view of the brake as it appears in the released position for impeding the movement of the snowboard.

Referring to FIGS. 1-3 of the drawings, there is shown a snowboard 11 equipped with a pair of safety release bindings 12. Each release binding 12 comprises a first attachment unit 13, a second attachment unit 14, and a pair of support pads 16. Each first attachment unit 13 comprises a substantially plane surface 17 throughout a central portion thereof, a support surface 18 (see FIG. 4) at each end thereof, and a first set of cohesive interlocking elements 19 secured on the plane surface 17. Each second attachment unit 14 is formed with a pair of plane surfaces 21 as shown in FIGS. 4 and 5, each of which has a second set of cohesive interlocking elements 22 secured thereon. During engagement, the first and second sets of cohesive attachment elements mesh together as illustrated in FIGS. 3-5.

As shown in FIGS. 1 and 5, the first attachment unit 13 is constructed as a boot holder designed to hold a skier's boot securely. It will be appreciated that the specific attachment of the attachment unit 13 to the foot of the user may be of any suitable form depending on the type of riding device utilized. In addition, the attachment may be direct or indirect (through a boot holder) as in the example shown herein.

Referring more particularly to FIG. 3, it is seen that the first set of cohesive interlocking elements 19 comprise a holding layer 23 for holding the individual elements 24. Each element 24 is composed of flexible, resilient elastomeric material, which is formed with a stem portion 26 held within and extending from the holding layer 23, and a semispherical head 27 which is larger than the stem portion to provide a cam surface 28. The second set of cohesive interlocking units 22 are constructed like the first set 19, and comprises a holding layer 29 for holding individual elements 31. Each element 31 is composed of material similar to the elements 24 and is formed with a stem portion 32, a head portion 33, shaped to provide cam surface 34.

It will be appreciated the the support pads 16 (as shown in FIGS. 1 and 4) are constructed to provide the spacing between the first and second attachment units, with the spacing provided to cause secure engagement of the interlocking elements. In this way, the support pads provide control for the user. As here shown, the support pads are separate units; however it will be appreciated that they may be made integral with the first attachment units or any other variation that will provide the spacing and control desired. In fact, it is contemplated that the support pads 16 may be advantageously attached the elongated strap 36 described below.

From the interlock shown in FIG. 3 and the fact that the interlock is planar as shown in FIGS. 1 and 2, it will be appreciated that considerable force is required to cause the interlock of the interlocking elements. In order to achieve easy interlocking, clamping means are provided in the second attachment unit 14. In addition, the unit 14 is constructed to provide adjustment of the interlocking elements.

Referring again to FIGS. 3-5, it is seen that the second attachment unit 14 here shown comprises an elongated strap 36 secured to the snowboard 11, said elongated strap having an inverted isosceles trapezoidal cross-section as shown in FIG. 4, and a pair of blocks 37 shown in FIG. 4 and 5 having upper plane surfaces 21 to which the second set of cohesive interlocking elements 22 are secured, and lower channels 38 formed to slidably fit on the elongated strap, whereby adjustment of the blocks 37 provides an adjustment of the interlocking positions of the first and second cohesive interlocking elements. This adjustment of position adjusts the release forces by alteration of the position and degree of interlock. The blocks 37 and strap 36 may have other suitable configurations so long as the positions of the blocks may be secured on clamping engagement of the cohesive interlocking elements to hold the blocks in position.

The clamping mechanism is best illustrated in FIG. 5, wherein the first attachment unit 13 is formed with extensions 39 on each side thereof, and the second attachment unit 14 is formed with a pair of clamping means 41 engagable with the extensions 39 for bringing the interlocking elements together. Each clamping means includes a link 42 with one end pivotally secured to the ends of the strap 36 through hinge pins 43, a pair of levers 44 pivotally attached near an end 46 to the other end of the link 42 through hinge pin 47.

As best seen in FIG. 5, clamping is effected by first swinging the links 42 upward while locating lever 44 at end 46 over the extensions 39 of the first attachment unit 13. Then the levers are rotated as shown by the arrows in FIG. 5 to force engagement of the first and second sets of cohesive interlocking elements. Surfaces 18 of the support pads 16 (see FIG. 4) hold the attachment 13 from moving the interlocking elements too far into mesh, and there is sufficient flexibility in the first attachment unit 13 to allow the interconnect to be effected and the be secure against excessive free play. Preferably, the attachment unit 13 is made of metal or other material with sufficient rigidity to effect the desired engagement of the first and second cohesive interlocking elements.

In the embodiment shown in the drawings, brake 48 also serves as one of the support pads 16. With this construction, the brake is located in operative position with respect to the first attachment unit for the attachment unit to release the lock on the brake and hold the brake in an operative position as will be more fully described.

Referring now to FIGS. 6–9, it is seen that brake 48 comprises a housing 49 secured to the snowboard 11. The housing is formed with a recess 51 on the upper surface and is formed with an open bottom that fits over the snowboard to form an elongated chamber 52. The remainder of the housing is solid in order to serve the function of a support pad. The chamber is formed with a female threaded opening 53 at one end extending through a side of the housing leaving a shoulder at the beginning of the threads.

The brake also comprises a generally U-shaped rod member 54 having a male threaded extension 56 at one end, and a flange 57 at the extremity of the threads 56. The flange 57 serves as a bearing or guide to retain axial alignment of the threads. The U-shaped rod member is also sized to fit into the recess and when in this position, the screw end is moved into the chamber. A compression spring 58 is also provided within the chamber 52, with the spring biased to urge the rod outwards. As shown in FIG. 9, when unrestrained, the spring urges the rod member outwards with the threads causing rotation until the flange 57 abuts the shoulder at the chamber end of the female threads. At this position, the extreme rod end swings downward, as indicated by the arrow in FIG. 8 until it reaches a position below the lower surface of snowboard 11. In this way, the rod member is moved into braking position.

Figure 8:
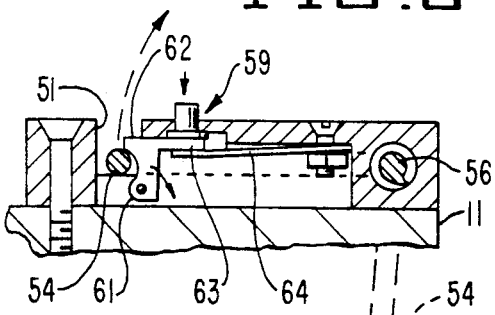
FIG. 8 is a sectional view taken substantially in the plane of line 8—8 of FIG. 6.
Figure 9:
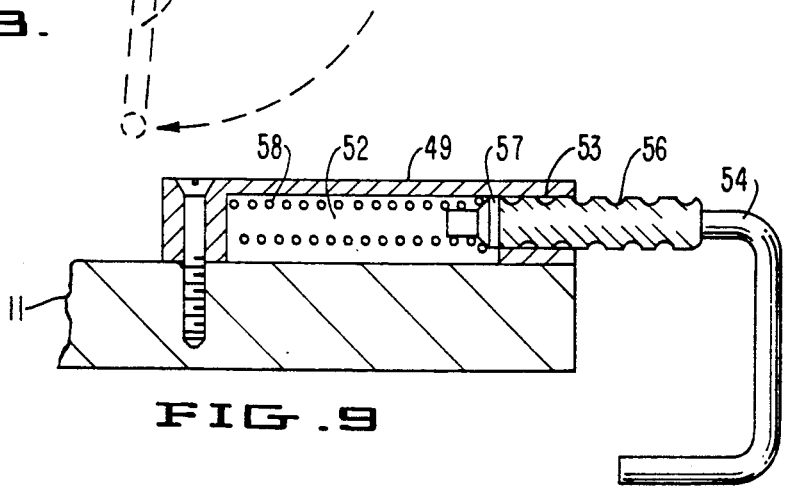
FIG. 9 is a sectional view taken substantially in the plane of line 9—9 of FIG. 7.

The brake also is provided with lock means 59 best shown in FIG. 8. As there shown, the lock means comprises a pivotally mounted lock member 61 formed with a retainer arm 62, and an actuator arm 63. Arm 63 is urged upwards by spring means in the form of a leaf spring 64 so that in the upward position, lock member 61 is position to hold rod 54. In order to move rod 54 in locked position, it is simply moved manually in rotation into the recess 51. As the rod reaches the recess 51, lock member 61 is retracted, by pushing downward on pushbutton 66. After member 61 is retracted, rod 54 is moved into the recess, and the pushbutton released. In this way, the brake is in the locked position as illustrated in FIG. 8.

In use, the first attachment unit fits down on the lock means, as may be seen in FIG. 1, and releases the lock means. However, rotation of rod 54 is prevented by the first attachment unit, where rod 54 remains until the attachment unit is removed. In the event of a separation of the release binding, the brake is then actuated to restrain movement of the snowboard.

The device is preferably made of metal except for the sets of cohesive interlocking elements. The layers of the cohesive interlocking elements are preferably secured to the metal surfaces of the attachment units by suitable epoxy adhesives. The other units are secured by conventional fasteners.

A snowboard constructed according to the invention was tested by use on a slope. It was found that the user had the usual control required to use the snowboard, and that excessive forces caused a release of the bindings.

From the foregoing description, it is seen that we have provided a safety release binding of generic application, which is relatively simple to construct, releasable in all force directions and rotations, and adjustable for fixing the forces necessary for release.

We claim:

1. A safety release binding for attachment of a foot of a user to a riding device, comprising a first attachment unit formed to be secured to the foot of the user, and comprising a substantially plane surface throughout a central portion thereof, a support surface at each end thereof, and a first set of cohesive interlocking elements secured on the plane surface at the central portion thereof, a second attachment unit secured to the riding device and formed with a substantially plane surface, comprising a second set of cohesive interlocking elements secured on the plane surface of the second attachment unit, and a pair of support pads disposed between the riding device and the support surfaces of the first attachment unit when the units are in operative use position, said support pads being formed to provide a spacing between the first and second attachment units to obtain a correct interlocking between the first and second set of interlocking elements, whereby controlling forces are transferred between the foot of the user and the riding device and an excessive force causes disengagement of the interlocking elements of the attachment units and release of the user's foot from the riding device.

2. A safety release binding as claimed in claim 1, wherein the second attachment unit comprises an elongated strap secured to the riding device, said elongated strap having an inverted isosceles trapezoidal cross-section, and a pair of blocks having upper plane surfaces, and lower channels formed to slidably fit and match a section on the elongated strap, said upper surfaces carrying the second set of cohesive interlocking elements in two separate areas, whereby the interlocking position of said cohesive interlocking elements are adjusted by sliding the blocks to a desired location on the strap.

3. A safety release binding as claimed in claim 2, wherein the first attachment unit is formed with extensions on each side thereof and in matching relation to the elongated strap of the second attachment unit, and the second attachment unit also comprises a clamping mechanism at each end thereof formed for engagement of the extensions of the first attachment unit, whereby the user can force the first and second cohesive interlocking elements into secure engagement.

4. A safety release binding as claimed in claim 3, wherein each clamping mechanism comprises a link pivotally attached to an end of the elongated strap, and a lever pivotally attached to the link near one end of the lever, said link being of such length that said end of the lever fits over an extension at the side of the first attachment unit.

5. A safety release binding as claimed in claim 1, wherein each of the first and second set of cohesive interlocking elements, comprises a holding layer for holding the interlocking elements, and means for securing each holding layer to the plane surfaces of the first and second attachment units, each of said interlocking elements composed of flexible, resilient elastomeric material and formed with a stem portion held within the holding layer and a semispherical head portion wider than the stem portion to provide a cam surface capable of engagement with the cam surface of opposing interlocking elements.

6. A safety release binding for attachment of each foot of a user to a snowboard, comprising a pair of first attachment units, each formed for attachment to a foot of the user, and each comprising
- a substantially plane surface throughout a central portion thereof,
- a support surface at each end thereof, and
- a first set of cohesive interlocking elements secured on the plane surface at the central portion thereof, a pair of second attachment unit secured to the snowboard, each formed with a substantially plane surface, and each comprising
- a second set of cohesive interlocking elements secured on the plane surface of the second attachment unit, and two pairs of support pads, each pair associated with a first attachment unit and disposed between the snowboard and the support surfaces of the first attachment unit when the units are in operative use position, said support pads being formed to provide a spacing between the first and second attachment units to obtain a correct interlocking between the first and second set of interlocking elements, whereby controlling forces are transferred between each foot of the user and the snowboard and an excessive force causes disengagement of the interlocking elements of the attachment units and release of the user's feet from the snowboard.

7. A safety release binding as claimed in claim 6, wherein each of the first and second sets of cohesive interlocking elements, comprise a holding layer for holding the interlocking elements, and means for securing each holding layer to the plane surfaces of each first and second attachment units, each of said interlocking elements being composed of flexible, resilient, elastomeric material, and formed in a generally mushroom shape with a stem portion held within the holding layer, and a generally semispherical head portion wider than the stem portion to provide a cam surface capable of engaging with the cam surface of opposing interlocking elements.

8. A safety release binding as defined in claim 7, wherein the second attachment unit comprises an elongated strap secured to the snowboard, said elongated strap having an inverted isosceles trapezoidal cross-section, and a pair of blocks having upper plane surfaces and lower channels formed to slideably fit on the elongated strap, said upper surfaces carrying the second set of cohesive interlocking elements in two separate areas, whereby the interlocking position of said cohesive interlocking elements are adjusted by sliding the blocks to a desired location on the strap.

9. A safety release binding as claimed in claim 8, wherein the first attachment unit is formed with extensions on each side thereof and in matching relation to the elongated strap of the second attachment unit, and the second attachment unit also comprises a clamping mechanism at each end thereof formed for engagement of the extensions of the first attachment unit, whereby the user can force the first and second cohesive interlocking elements into secure engagement.

10. A safety release binding as claimed in claim 9, wherein each clamping mechanism comprises a link pivotally attached to an end of the elongated strap, and a lever pivotally attached to the link near one end thereof, said link being of such length that said end of the lever fits over an extension at the side of the first attachment unit.

11. A safety release binding for attachment of each foot of a user to a snowboard, comprising a first attachment unit formed to be secured to the foot of the user, a second attachment unit secured to the snowboard, and a brake mounted on the snowboard near the edge thereof and part of which is under a normal operative position of the first attachment unit, said brake comprising
- a housing secured to the snowboard and having a recess on the upper surface thereof,
- said housing also having an elongated internal chamber open at one end and containing female threads at the opening,
- a generally U-shaped rod member having a male threaded section at one end of one leg with the male threads fitting the aforesaid female threads and having the other leg of the U fitting into the recess on the upper surface of the housing when the male end in within the chamber,
- spring means located within the chamber compressed to urge the U-shaped rod member outward thereof causing rotation from the position with the other leg of the U-shaped member in the recess to a final position below the snowboard,
- lock means for holding the leg of the U-shaped member in the recess, and
- means for releasing said lock means.

12. A safety release binding as defined in claim 11, wherein the means for releasing said lock means is actuated by the first attachment unit when covering the recess in the housing thereby holding the U-shaped rod member within the recess in an unlocked relation.

* * * * *